US005679156A

United States Patent [19]

Matsumaru

[11] Patent Number: 5,679,156

[45] Date of Patent: Oct. 21, 1997

[54] CHARACTER ERASER CASE

[75] Inventor: Ryoji Matsumaru, Kasiwa, Japan

[73] Assignee: Tombow Pencil Co., Ltd., Tokyo, Japan

[21] Appl. No.: 622,356

[22] Filed: Mar. 27, 1996

[30] Foreign Application Priority Data

Mar. 28, 1995 [JP] Japan ..... 7-093206

[51] Int. Cl.[6] ..... B05C 1/00

[52] U.S. Cl. ..... 118/200; 118/257; 156/577; 156/579; 242/538.1; 242/538.3

[58] Field of Search ..... 118/200, 257; 400/695, 696, 700; 156/577, 579; 242/538.1, 538.3

[56] References Cited

U.S. PATENT DOCUMENTS

| | | | |
|---|---|---|---|
| D. 355,934 | 2/1995 | Oga et al. | D19/69 |
| 4,671,687 | 6/1987 | Tamai . | |
| 4,826,562 | 5/1989 | Ehlis | 156/577 |
| 4,853,074 | 8/1989 | Manusch et al. | 156/577 |
| 4,891,090 | 1/1990 | Lorincz et al. | 156/577 |
| 5,006,184 | 4/1991 | Manusch et al. | 156/577 |
| 5,125,589 | 6/1992 | Manusch | 242/67.3 |
| 5,310,445 | 5/1994 | Tucker | 156/574 |
| 5,346,580 | 9/1994 | Elges et al. | 156/577 |
| 5,379,477 | 1/1995 | Tamai et al. | 118/257 |
| 5,393,368 | 2/1995 | Stevens | 156/577 |
| 5,430,904 | 7/1995 | Ono et al. | 15/104.94 |
| 5,480,510 | 1/1996 | Manusch et al. | 156/577 |
| 5,490,898 | 2/1996 | Koyama | 156/540 |

*Primary Examiner*—Laura Edwards

*Attorney, Agent, or Firm*—Baker, Donelson, Bearman & Caldwell

[57] ABSTRACT

In a character eraser case in which a cartridge body having a feed reel and a take-up reel and a take-up reel integrally and rotatably held through a continuous correction paint transfer tape is inserted into a main body, the replacement of the correction paint transfer tape by a new one is facilitated, the peeling of a correction paint applied onto the surface of the correction paint transfer tape is prevented and the twisting or looseness of the correction paint transfer tape in the main body is prevented. The cartridge body 15 is detachably inserted into the main body 2. The cartridge body 15, the substrate 14 on which a feed reel shaft 7 and a take-up reel shaft 8 are provided and a transfer head 9 are formed as a unitary body. One end of the main body 2 is formed in a two-layer structure. One member forming the two-layer structure is a slide cover 21 slidable in the vertical direction relative to the other member. Further, transfer tape guides 25 and 26 for supporting and guiding the side edges of the transfer tape 3 are provided in the main body 2. Furthermore, a head cover for covering the transfer head 9 is provided. A transfer head support member 18 of the cartridge body 15 is provided with protruding members 27. Protruding edges 33 are formed on the inner wall of the main body 2. Thus, various kinds of problems associated with the correction paint transfer tape are overcome and a smooth insertion of the cartridge body 15 into the main body 2 is accomplished.

11 Claims, 9 Drawing Sheets

CHARACTER ERASER CASE

FIELD OF THE INVENTION

The present invention relates to an improvement in a character eraser employed at the time of correcting characters or the like of a manuscript.

DESCRIPTION OF THE PRIOR ART

Various kinds of conventional character erasers have been proposed which utilize a correction paint transfer tape for correcting the characters of a manuscript or the like. For example, Japanese Examined Patent Publication No. 3-11639 discloses a character eraser in which a feed reel on which a correction paint transfer tape is wound and a take-up reel for winding the correction paint transfer tape formed integrally with the feed reel through the correction paint transfer tape. These reels are rotatably held in a magazine, and the correction paint transfer tape extending and fed between the feed reel and the take-up reel is exposed to an external part through a head protruding outside from a rear part in the magazine. In accordance with the character eraser disclosed in the above-mentioned publication, a character erasing operation is performed in such a way that the externally exposed correction paint transfer tape and the head are moved in a prescribed direction with the transfer tape and the head abutting against, and pressed to, a portion subjected to a character erasing operation, the used correction paint transfer tape is wound on the take-up reel rotatably held in the magazine. In accordance with the prior art character eraser as stated above, when a plurality of characters are continuously erased, the correction paint transfer tape used for the character erasing operation is supplied from the feed reel while the correction paint transfer tape after use is wound on the take-up reel. Therefore, the character erasing operation can be very efficiently carried out. However, in the case where a single character is erased, or more specifically in the case where the distance of movement of the head in the character erasing operation is significantly small, a disadvantage has been encountered since the correction paint transfer tape cannot be assuredly wound on the take-up reel because of the looseness of the used correction paint transfer tape. In this instance the head has to be moved once on the surface of a sheet, etc., in order to employ the character eraser for the next operation, which has resulted in an inconvenient operation for the user.

Consequently, for assuredly winding the used correction paint transfer tape on the take-up reel, one of the character erasers which has been proposed includes a feed reel on which a correction paint transfer tape is wound and a take-up reel are provided in parallel, gears are provided respectively coaxially with the reels,and these gears mesh with each other to thereby effectively and surely wind the correction paint transfer tape on the take-up reel.

Further, in order to improve ease of handling, one type of character eraser has been proposed in which a feed reel and a take-up reel are disposed in a superposed condition, a gear provided coaxially with the feed reel meshes with a gear provided coaxially with the take-up reel and a tubular member for accommodating both the reels is formed in a substantially cylindrical shape.

However, in the prior art character erasers, since the shaft of the feed reel is formed integrally with the tubular member, there have been brought about undesirable defects. Specifically stated, when the remaining amount of a correction paint transfer tape wound on the feed reel reaches zero or a small value, the used correction paint transfer tape taken up by a take-up reel must be removed and a new correction paint transfer tape must be mounted on the feed reel. Further, in order to deliver and extend the new correction paint transfer tape to the take-up reel, the engagement of the tubular member with the reels has to be released to thereby divide the tubular member into two portions in parallel with an axis thereof and expose the reel parts. In addition, parts for fixing the gears to the reels have to be disengaged so that the feed reel is exposed. Therefore, much time and labor is required to change the correction paint transfer tape.

Still further, there has arisen a defect that since the correction paint transfer tape is always exposed in the end part of a transfer head, the exposed part of the tape at the end is unnecessarily pressed to a part of an object and a correction paint is undesirably transferred thereto, so that the part in question is stained or broken and the capability of the correction paint transfer tape itself is disadvantageously lost.

Additionally, the foregoing conventional erasers are subject to twisting or looseness in the correction paint transfer tape which is drawn and extended between the respective reels and the end part of the transfer head. As a result of these defects the feed or take-up of the correction paint transfer tape is interrupted, or the tape comes not contact with the inner wall of the tubular member, so that the paint applied onto the surface of the tape is removed, thereby deteriorating the capability of the character eraser.

SUMMARY OF THE INVENTION

For meeting the above stated problems, an object of the present invention is to provide a character eraser case by which: the disadvantages of the above stated prior art can be solved; a correction paint transfer tape can be readily replaced by a new one in a short time; a paint applied onto the correction paint transfer tape is prevented from being peeled in the part of a transfer head around which the correction tape is wound by covering the end of the transfer head for exposing the correction tape upon no use; and the twisting or looseness of the correction paint transfer tape and the peeling of the correction paint are avoided in a tubular body.

For readily replacing a correction paint transfer tape with a new one in a short time, a cartridge body is attachably and detachably inserted into a main body. This cartridge body, a substrate on which a feed reel shaft and a take-up reel shaft are provided and a transfer head are formed as a unitary body. In addition, a feed reel and a take-up reel are provided in a superposed position and a gear provided coaxially with the feed reel meshes with a gear provided coaxially with the take-up reel. Further, to prevent a paint of a correction paint transfer tape from being peeled off by a part of the transfer head around which the transfer tape is wound, the main body is formed in a two-layer structure. One member forming the two-layer structure is formed as a slide cover slidable in the vertical direction relative to the other member so as to hide the end part of the transfer head. Still further, in order to prevent the twisting, etc. of the correction paint transfer tape and the peeling of the correction paint in the cartridge body, transfer tape guides are provided for guiding and supporting the side edges of the transfer tape in a tubular body, a head cover for covering the transfer head is provided, protruding members are formed in a transfer head support member of the cartridge body or protruding edges are formed in the inner wall of the main body.

In accordance with the character eraser case of the invention having the above-described construction, in the situation where the correction paint transfer tape is replaced by a new one, the cartridge body is detached from the main body and the substrate and the transfer head are similarly detached since they are formed integrally with the cartridge body. As a result, since the feed reel and the take-up reel themselves and the transfer head are exposed to the outside, a new correction paint transfer tape can be easily and readily mounted on the feed reel in a short time and the transfer tape can be delivered and extended to the take-up reel through the transfer head. In addition thereto, the feed reel and the take-up reel are disposed in a superposed state, and the gear provided coaxially with the feed reel meshes with the gear provided coaxially with the take-up reel. Therefore, while maintaining the ease of replacement of the correction paint transfer tape, the entire size of the character eraser case can be miniaturized. Further, an inside member forming the two-layer structure in the end part of the main body is the slide cover slidable in the vertical direction relative to an outside member. Therefore, when the transfer head is not in use, the end part of the transfer head can be accommodated in the inside member which is moved forward, thereby covering the end part of the transfer head. Accordingly, the correction paint transfer tape located in the end part of the transfer head can be protected. Still further, the correction paint transfer tape guides for guiding the correction paint transfer tape are provided in the cartridge body, so that the twisting, etc. of the correction paint transfer tape or the removal of the correction paint in the cartridge body can be prevented. Furthermore, the transfer head is covered with a head cover with only the end part of the transfer head exposed, and therefore, problems generated between portions of the tape situated in separate positions because of the looseness of the tape can be avoided. Moreover, the transfer tape can be smoothly fed and the cartridge body can be readily inserted into the main body.

BRIEF DESCRIPTION OF THE DRAWINGS

Other features and advantages of the present invention will be apparent from the following description taken in connection with the accompanying drawings, wherein.

DETAILED DESCRIPTION OF THE PREFERRED EMBODIMENTS

Figure 1:
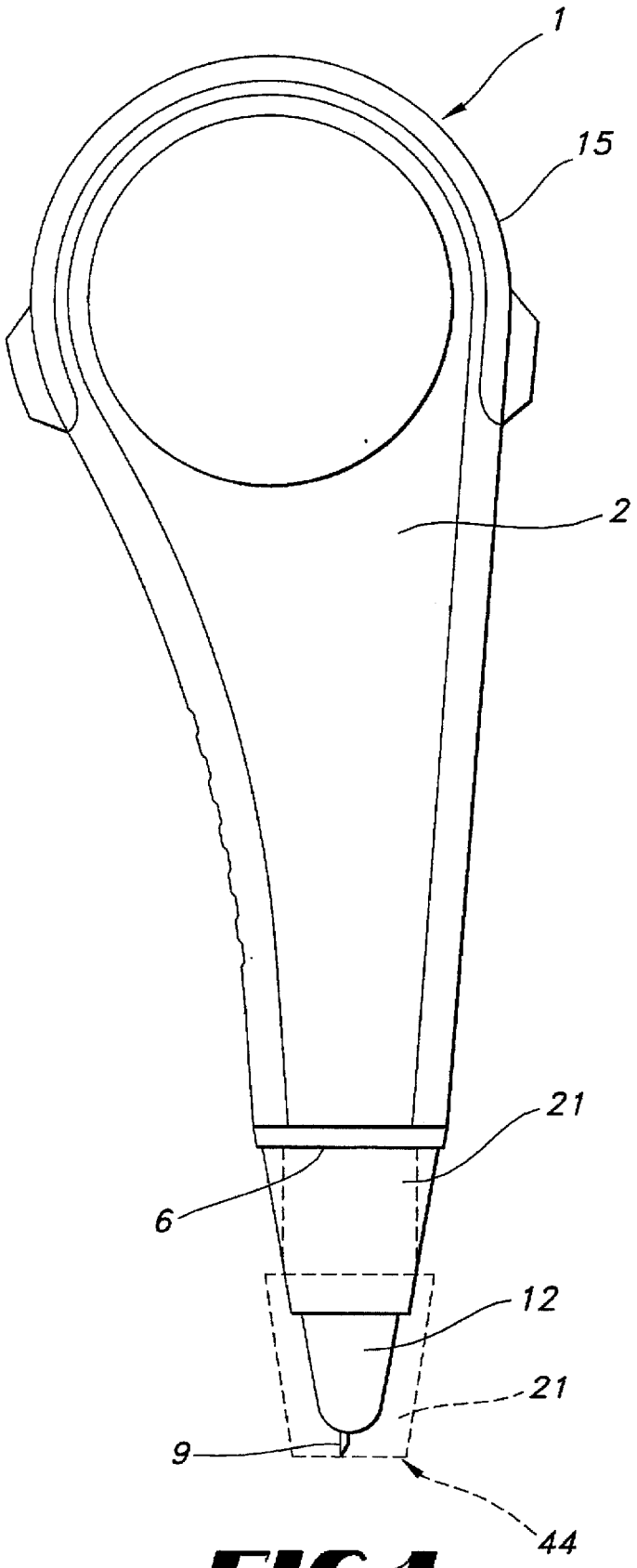
FIG. 1 is a front view of a first embodiment of a character eraser case according to the present invention.
Figure 2:
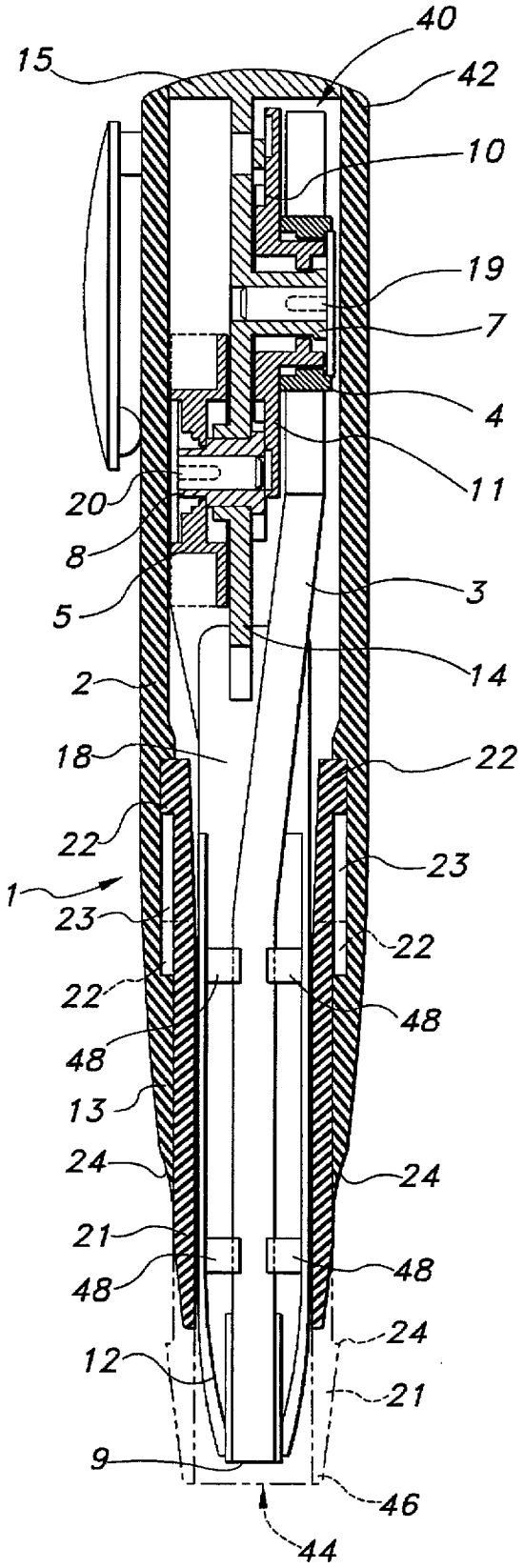
FIG. 2 is a longitudinal sectional view of the character eraser case shown in FIG. 1.

The present invention will now be described in more detail, by way of embodiments, with reference to the accompanying drawings. Reference numeral 1 designates a character eraser case according to the present invention. This character eraser case 1 comprises a main body 2 and a cartridge body 15. The main body 2 holds a feed reel 4 on which an unused correction paint transfer tape 3 is wound and a take-up reel 5 which is connected integrally with the feed reel 4 through the correction paint transfer tape 3 so as to be rotatable therein. The cartridge body 15 is formed integrally with the axes 7 and 8 of the feed reel 4 and the take-up reel 5 and a substrate 14. A transfer head 9, for projecting from the tip of the main body 2 the correction paint transfer tape 3 pulled out of the main body 2, is provided with a head cover 12 for guiding the correction paint transfer tape 3. The feed reel 4 and the take-up reel 5 which are integrally and rotatably held through a continuously pulled-out correction paint transfer tape 3 in the main body 2 are superimposed one upon another with respect to the substrate 14 in the main body 2 which is disposed in parallel with the cross-section of the main body 2 as an original position. A feed reel gear 10 having external teeth on the feed-reel side of the substrate 14 is provided. The feed reel gear 10 is coaxial with a feed reel shaft 7 operating as a rotation axis of the feed reel 4. Meanwhile, a take-up reel gear 11 having external teeth on the feed-reel side of the substrate 14 is provided. The take-up reel gear 11 is coaxial with a take-up reel shaft 8 operating as a rotation axis of the take-up reel 5. The feed reel gear 10 comes into external contact with and meshes with the take-up reel gear 11. End parts at both sides of the cartridge body 15 inserted into the main body 2 are made of an elastic material and are formed so as to be provided with engaging step parts 16. The cartridge body 15 is inserted into the main body 2 through an opening 40 in a proximal end 42 of the main body 2. At the extreme ends in the base bottom side of wall surfaces of main body part 13 of the main body 2, engaging step receiving parts 17 are formed. Thus, the cartridge body 15 is detachably engaged with and fixed to the main body part 13 of the main body 2. The substrate 14 disposed in parallel with the cross section of the main body 2 therein is connected and fixed to the inside of the cartridge body 15 in the base bottom side of the main body 2. On the other hand, in the tip end side of the main body 2, the substrate 14 is connected and fixed perpendicularly to a transfer head support member 18 for supporting the transfer head 9. A feed reel fixing pin 19 is detachably fitted into the feed reel shaft 7 so that the feed reel 4 is fixed. A take-up reel fixing pin 20 is detachably fitted into the take-up reel shaft 8 so that the take-up reel 5 is fixed.

A slide cover 21 is formed in a substantially cylindrical and hollow shape and provided with sliding engagement protrusions 22 in a base bottom side in the outside thereof and engagement protrusions 24 at a substantially tip end side thereof, respectively. The sliding engagement protrusions 22 are slidably engaged in sliding grooves 23 provided in the inner wall of the tip end side of the main body part 13 of the main body 2. The extremity end parts of the main body part 13 of the main body 2 are capable of engaging with the engagement protrusions 24. Then, the slide cover 21 is slidable within a range of the entire length of the sliding grooves 23 relative to the main body part 13 of the main body 2. In the case where the slide cover 21 is retracted most backward, the transfer head 9 is exposed by the extremity end part thereof. In this instance a tip end of transfer head 9 protrudes through an opening 44 in a distal end 46 of the main body 2 which corresponds to the extremity end part of the slide cover 21. On the other hand, in the case where the slide cover 21 is advanced most forward, the transfer head 9 is hidden by the extremity end part of the slide cover 21.

Figure 3:
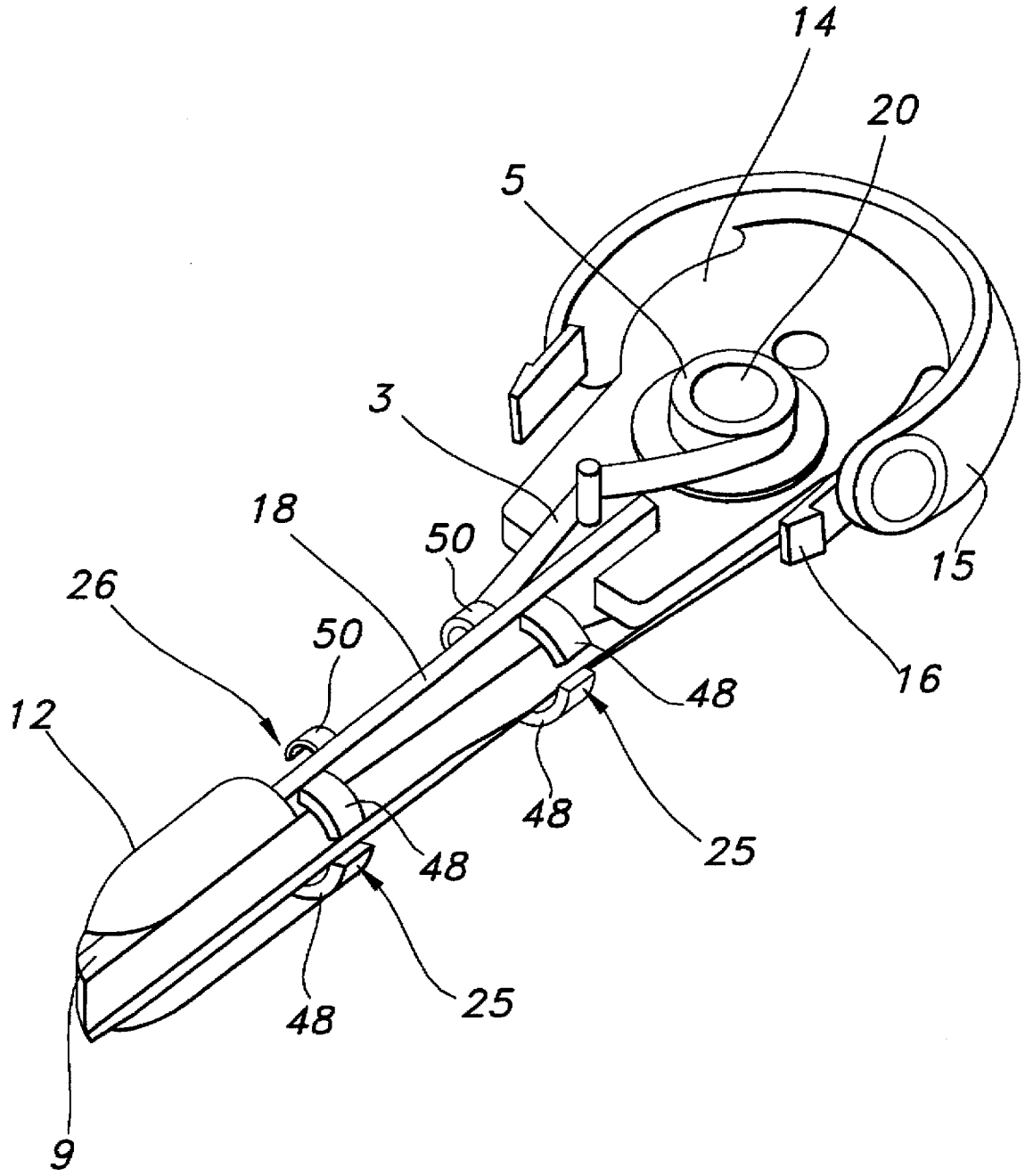
FIG. 3 is a perspective view of a cartridge body constituting the character eraser case shown in FIGS. 2 and 3.

In the illustrated embodiment shown in FIG. 3, the character eraser case 1 further includes a pair of correction paint transfer tape guides 25 attached to the transfer support member 18 and a pair of correction paint transfer tape guides 26 which are also attached to the support member 18. As shown in FIG. 3, the tape guides 25 are attached to a first side of the support member 18 which may be referred to as the feed-reel side of member 18 since the transfer tape 3 extends along this side of member 18 between the feed reel 4 and the transfer head 9. Similarly, the opposite side of member 18, to which tape guides 26 are attached, may be referred to as the take-up-reel side of member 18. Each of the tape guides 25 include a pair of arcuate members 48 attached at a proximal end thereof to the support member 18. The distal ends of the pair of arcuate members 48 are spaced from one another so as to form a notch in the tape guide 25. Similarly, each of the tape guides 26 includes a pair of arcuate members 50 (only one shown for each guide 26) which are attached at a proximal end thereof to the opposite side of the support member 18. The distal ends of the pair of arcuate members 50 forming each tape guide 26 are spaced from one another so as to form a notch in each tape guide 26. Additionally, as shown in FIG. 3, the tape guides 25 are mis-aligned vertically with respect to the tape guides 26 such that an upper one of the tape guides 25 is disposed in closer proximity to the substrate 14 than an upper one of the tape guides 26 and a lower one of the tape guides 25 is disposed in closer proximity to the transfer head 9 than a lower one of the tape guides 26.

Thus, the correction paint transfer tape 3 is extended respectively inside the transfer tape guides 25 located on the feed-reel side of member 18 and the transfer tape guides 26 located on the take-up-reel side of member 18. In constructing the character eraser case 1 of an embodiment according to the present invention and transferring a correction paint film to a surface to be transferred, the transfer head 9 is bent and held so that the correction paint transfer tape 3 is put into close contact with the surface in question. In this transfer head 9, tape inserting holes 34 which respectively form a prescribed tape feed passage and a prescribed tape take-up passage between the transfer head 9 and the respective transfer tape guides are covered with a head cover 12 fixed to the transfer head support member 18.

Since the character eraser case 1 according to the present invention is provided with the construction as stated above, in the case where the remaining amount of the correction paint transfer tape 3 wound on the feed reel 4 has become zero or small so that the correction paint tape 3 has to be replaced by a new one, the end part of the cartridge body 15 is pressed so that the engagement between the engaging step parts 16 provided at the end part of the cartridge body 15 and the engaging step receiving parts 17 of the main body part 13 of the main body 2 is released. Then, as the cartridge body 15 is pulled out of the main body part 13 of the main body 2, the substrate 14, the transfer head support member 18 and the transfer head 9 integrally connected with the cartridge body 15 are simultaneously pulled out of the main body part 13 of the main body 2. As a result, the feed reel 4 and the take-up reel 5 provided on the substrate 14 are completely externally exposed. Then, a feed reel fixing pin 19 and a take-up reel fixing pin 20 for respectively retaining the feed reel 4 and the take-up reel 5 are pulled out of the feed reel shaft 7 and the take-up reel shaft 8. Consequently, the correction paint transfer tape 3 wound on the respective reels 4 and 5 can be removed. Under this state, a new correction paint transfer tape 3 is wound on the feed reel 4 and the end of this tape 3 is fixed to the take-up reel 5 through the tip end part of the transfer head 9. Then, the tip end part of the transfer head 9 is first inserted into the substrate side in the main body part 13 of the main body 2, so that the engaging step parts 16 formed in the cartridge body 15 are engaged with the engaging step receiving parts 17 formed in the main body part 13 of the main body 2. In this way, the cartridge body 15 is secured to the main body part 13 of the main body 2 and the correction paint transfer tape 3 is Changed. In this case, if the cartridge body 15 in which an old transfer tape is previously replaced by a new one is inserted into the main body 2, the replacement thereof can be immediately performed.

When the character eraser case 1 is employed, the transfer head 9 has to be exposed to the outside. However, when the character eraser case 1 is not employed, it is necessary to cover the transfer head 9 itself on which the correction paint tape 3 is extended and wound in order to prevent the correction paint transfer tape 3 from being peeled. Therefore, the end part of the transfer head 9 is accommodated in the slide cover 21 by moving the slide cover 21 forward toward the end side along the sliding grooves 23 until the sliding engagement protrusions 22 are engaged with the extreme ends of the sliding grooves 23. On the contrary, when the character eraser case 1 is employed, the slide cover 21 is moved backward toward the base bottom side along the sliding grooves 23 until the sliding engagement protrusions 22 are engaged with the rearmost parts of the sliding grooves 23 and the extreme ends of the main body part 13 of the main body 2 are engaged with the engagement protrusions 24 formed on the outer surface of the slide cover 21, so that the end part of the transfer head 9 is exposed to an external part.

In addition, in the case where the transfer tape guides 25 are provided on the feed-reel side and the transfer tape guides 26 are provided on the take-up-reel side of member 18, upon replacement of the above stated correction paint transfer tape 3, when a new correction paint transfer tape 3 is extended and delivered from the feed reel 4 to the transfer head 9, and from the transfer head 9 to the take-up reel 5, the correction paint transfer tape 3 is inserted into the respective guides 25 and 26 from the respective top parts cut-out in the guides 25 and 26. Thus, the correction paint transfer tape 3 can be supported in the respective guides 25 and 26. Since the guides 25 and 26 are comprised of arcuate members, the correction paint transfer tape 3 does not unnecessarily come into contact with the respective guides 25 and 26, and the amount of peeling of correction paint on the correction paint transfer tape 3 can be minimized.

Figure 7:
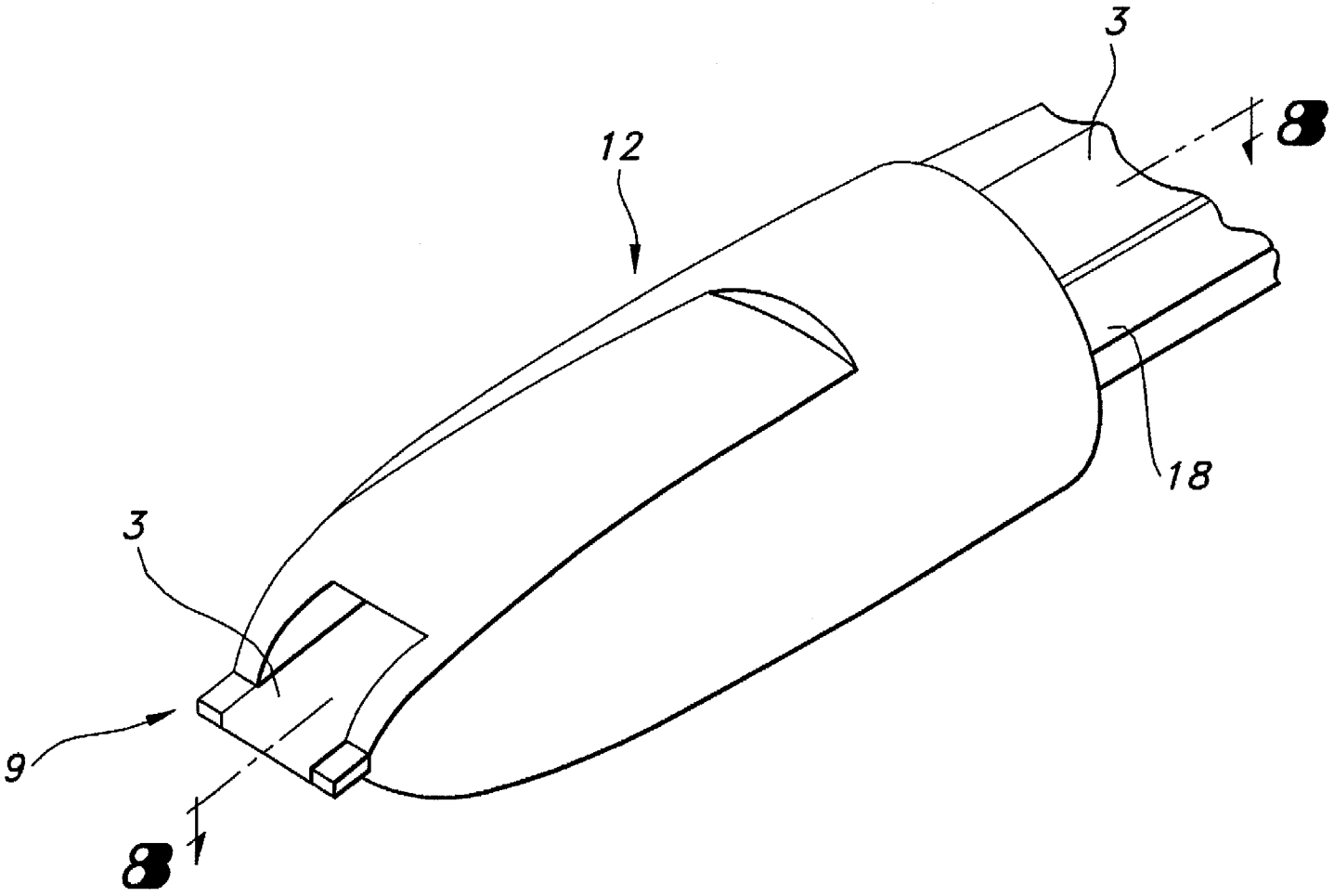
FIG. 7 is a fragmentary perspective view illustrating an end part of the character eraser case of the first embodiment according to the present invention.
Figure 8:
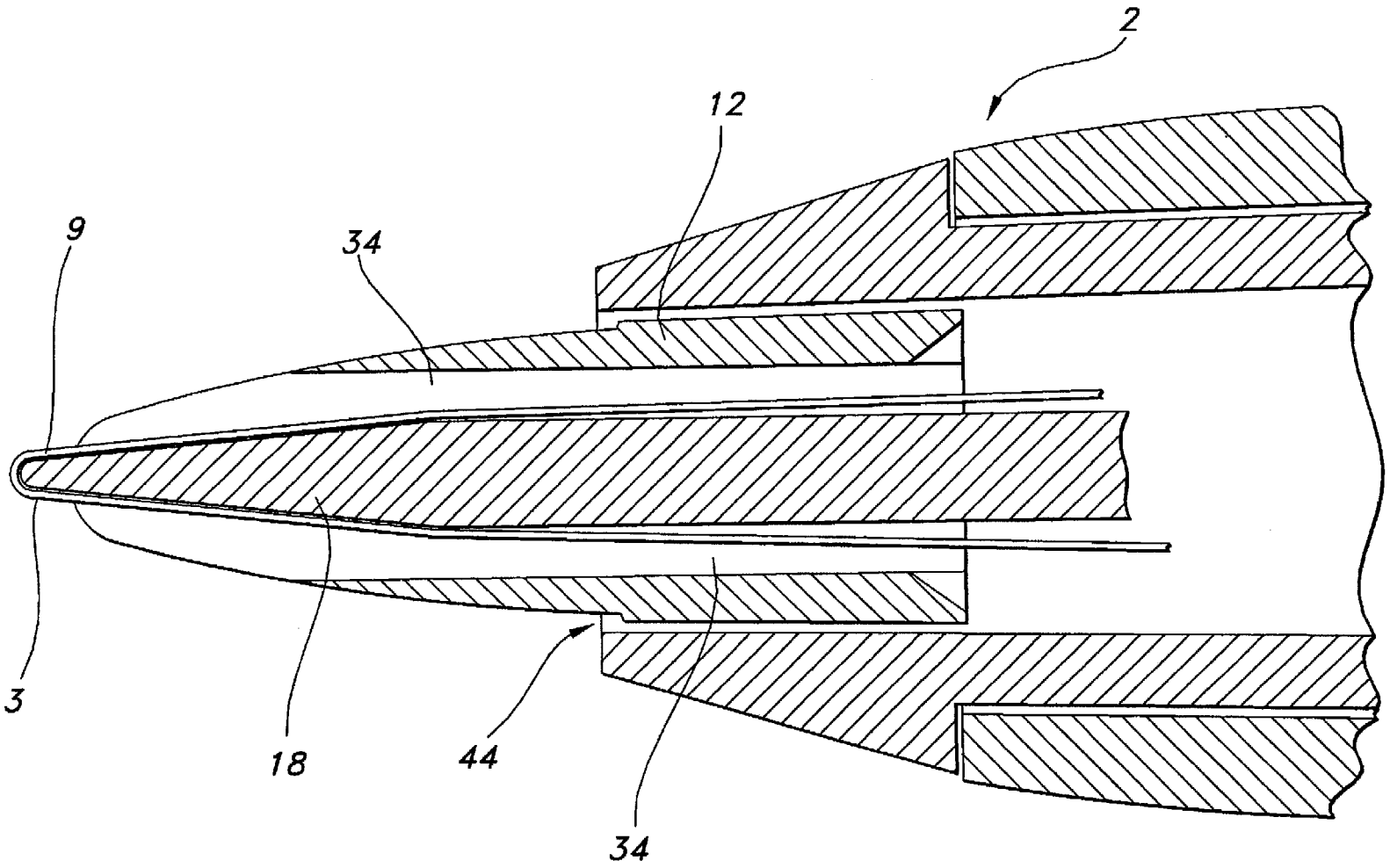
FIG. 8 is a cross-sectional view taken along line 8—8 in FIG. 7.

Further, when the correction paint transfer tape 3 which must be ordinarily wound on the feed reel 4 or the take-up reel 5 is loosened or unwound as a result of rotation of a mechanism for feeding and winding the correction paint transfer tape 3 because of an erroneous operation such as vibration, the correction paint transfer tape 3 is fixed to an opening part 6 of the main body 2 of the character eraser member, while the portion of the correction paint transfer tape 3 wound on the feed reel 4 for guiding the correction paint transfer tape 3 outside the main body 2 and the portion of the tape 3 wound on the take-up reel 5 for the feed reel 4 which is used to bring the correction paint transfer tape 3 into direct contact with a surface to be transferred are only left as they are. In this manner, the correction paint transfer tape 3 is guided from the feed reel 4 to the take-up reel 5 through the transfer head 9 by the tape inserting holes 34 constituted of the tape feed passage and the tape take-up passage which are formed with the head cover 12 (See FIGS. 7 and 8). Therefore, the correction paint transfer tape 3 can be securely prevented from being separated from or being disengaged from the transfer head 9 which generally serves to guide the correction paint transfer tape 3, owing to the erroneous operation of the feed reel 4 or the take-up reel 5. Furthermore, such a disadvantage as a mutual adhesion of the correction paint transfer tape 3 resulting from the erroneous operation of the feed reel 4 or the take-up reel 5 of the correction paint transfer tape 3 can be prevented. FIG. 8 is a section taken along line 8—8 in FIG. 7.

In addition, the transfer head 9 for guiding the correction paint transfer tape 3 wound on the feed reel 4 or the take-up reel 5 which are accommodated in the main body 2 forming the character eraser case 1 is covered with the head cover 12 fixed to the cartridge body 15 with the end part of the transfer head 9 in close contact with the surface to be transferred with the correction paint. Therefore, inadvertent transfer of the correction paint to an article surface can be prevented during the following conditions: when the correction paint transfer tape 3 is separated or disengaged from the transfer head 9 for guiding the correction paint transfer tape 3 since the correction paint transfer tape 3 is loosened or unwound due to the erroneous function of the feed reel 4 or the take-up reel 5 and when the end of the transfer head 9 for guiding the correction paint transfer tape 3 unexpectedly comes into contact with another article.

Figure 4:
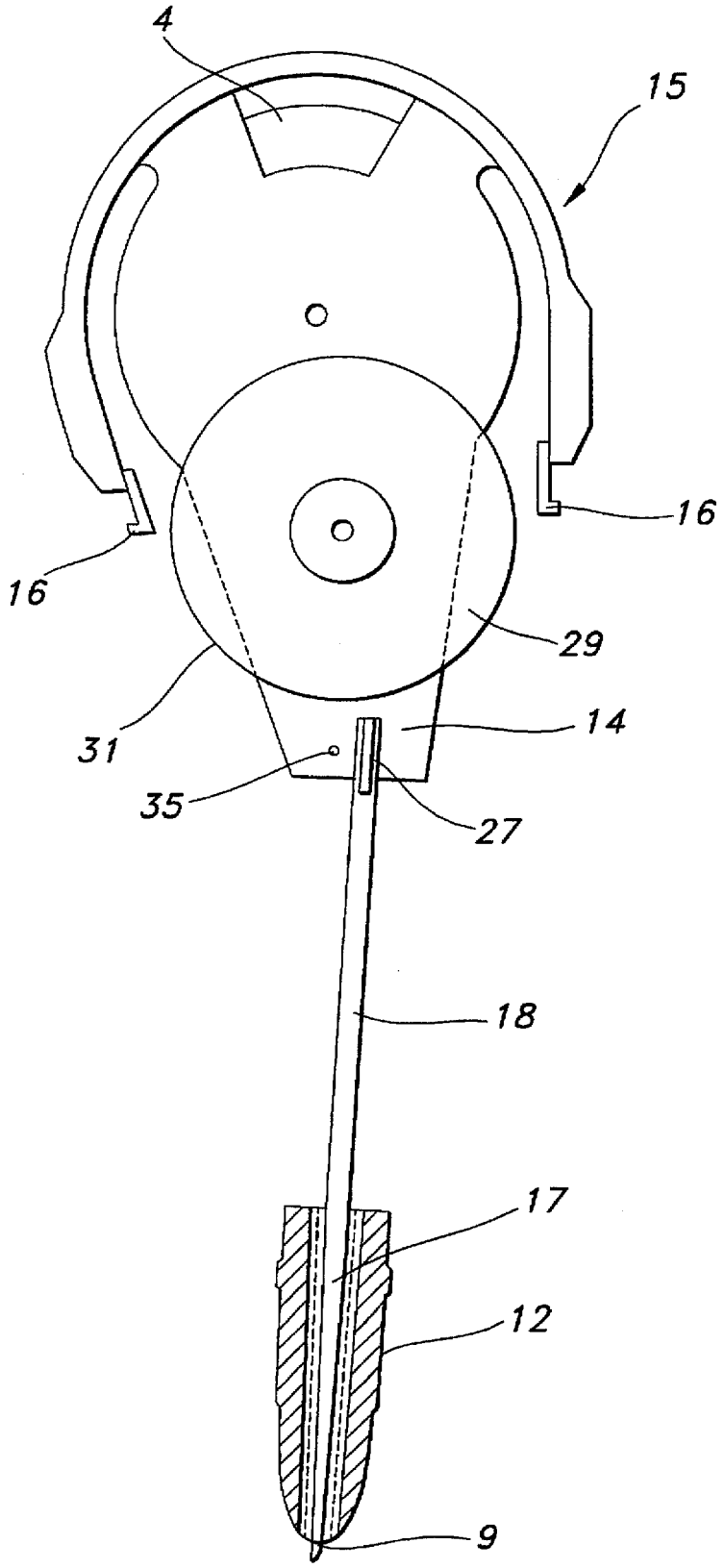
FIG. 4 is a front view of a cartridge body of another embodiment of a character eraser case according to the present invention which has protruding members in a transfer head support member.
Figure 5:
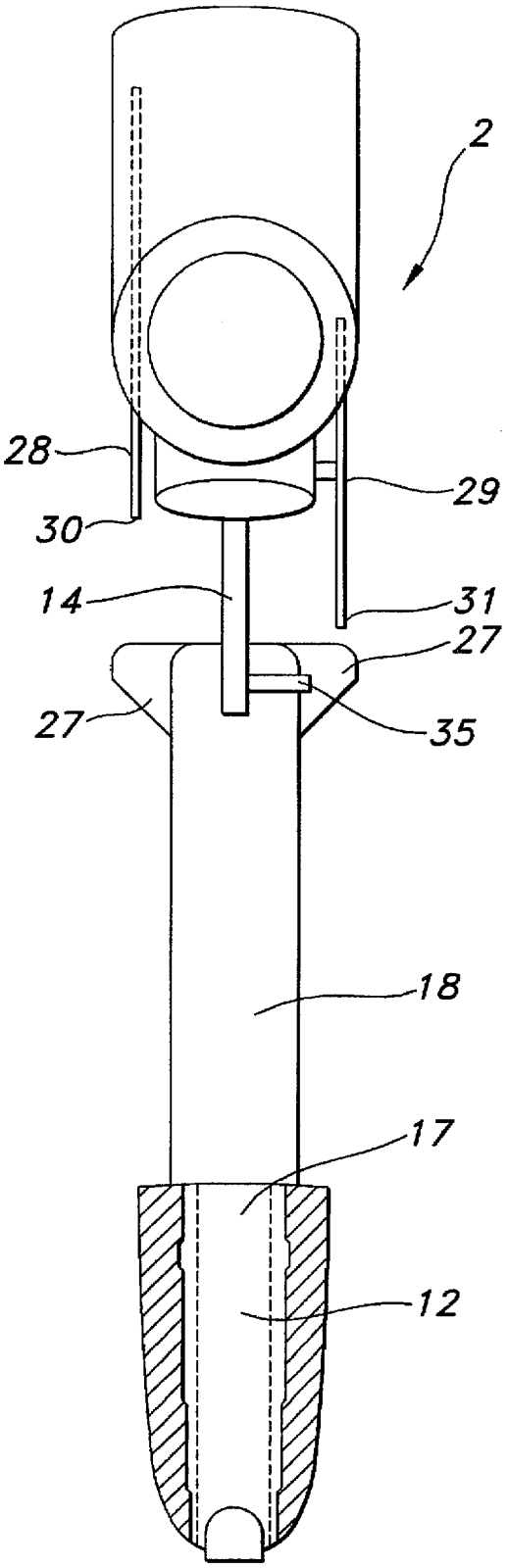
FIG. 5 is a side view of the cartridge body shown in FIG. 4.
Figure 6:
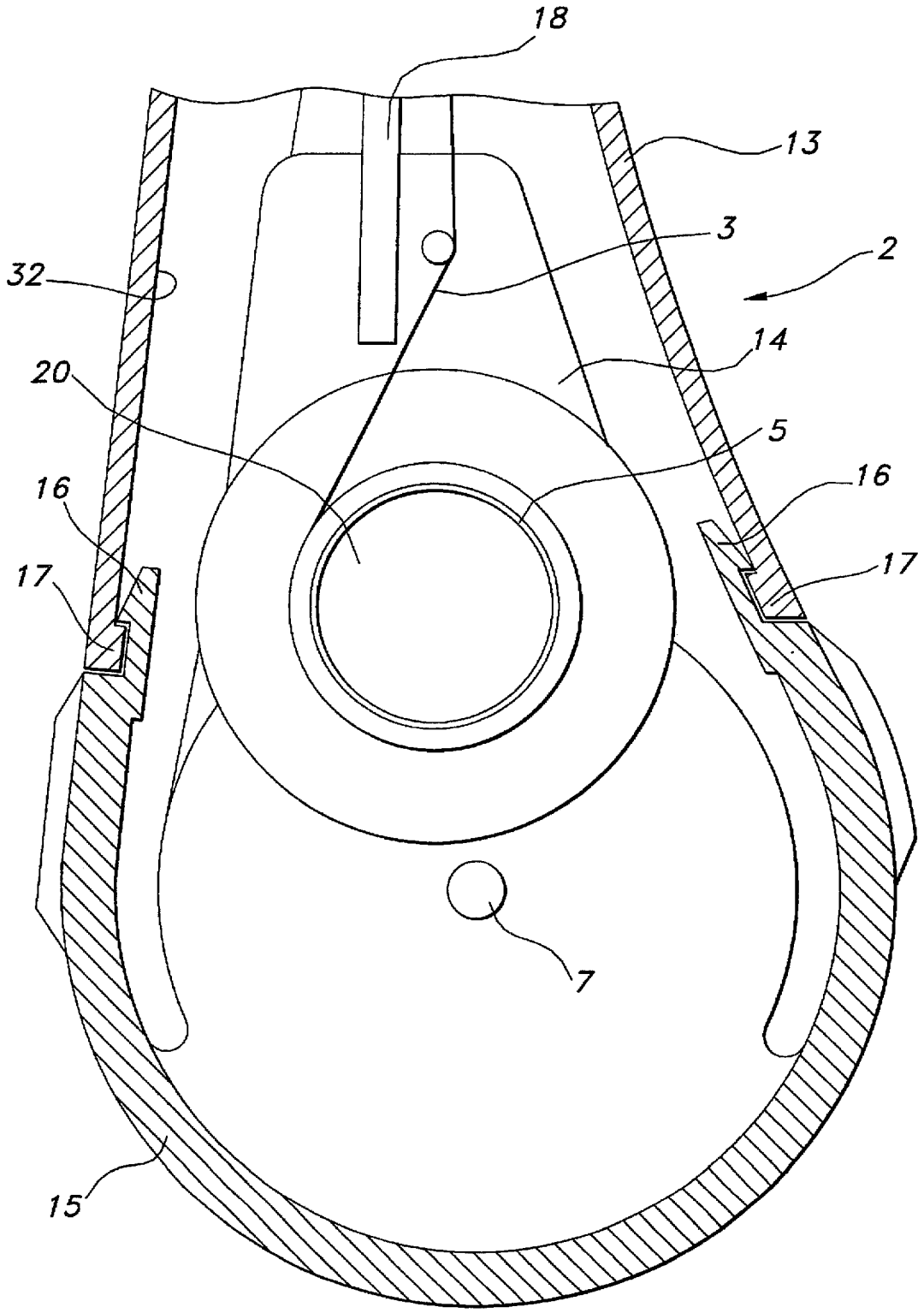
FIG. 6 is a partly enlarged view illustrating the assembly of the main body of the character eraser case of the first embodiment according to the present invention to the cartridge body.
Figure 9:
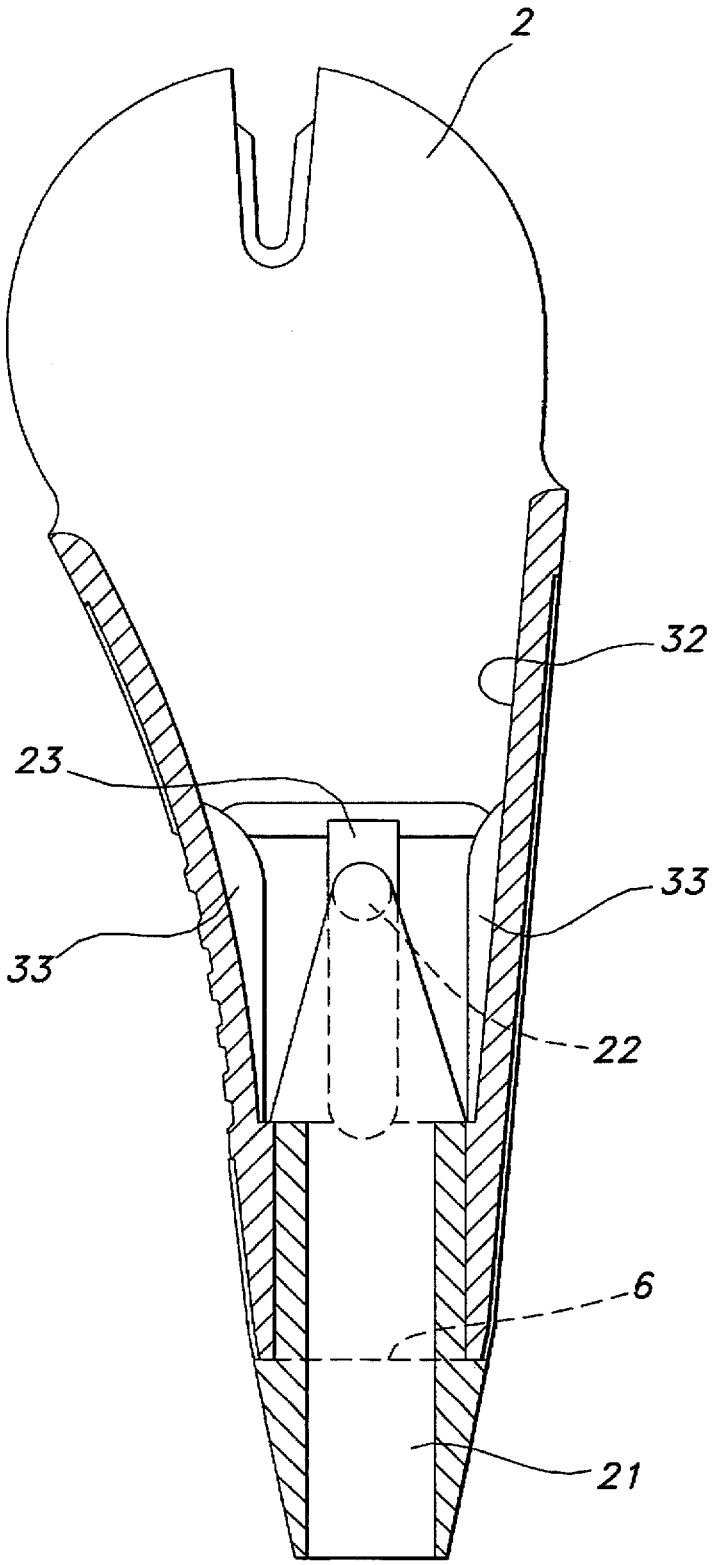
FIG. 9 is a longitudinally sectional front view of the main body of the main body of the character eraser case according to the present invention.

In the root part of the transfer head support member 18 of the main body 2 in which the mechanism for feeding and winding the above-mentioned correction paint transfer tape 3 is disposed, protruding members 27 and 27 extending in a horizontal direction are provided (Refer to FIGS. 4, 5 and 9). The cartridge body 15 is inserted into the main body 2 upon assembling the character eraser case 1 or change of the cartridge body 15 containing the correction paint transfer tape 3. In this case, the inserting operations can be more smoothly carried out by virtue of the subsequently described structure. A reel cover 28 is provided outside the feed reel 4 mounted on the cartridge body 15 for the purpose of feeding and circulating the correction paint transfer tape 3 in order to protect the transfer tape 3. A reel cover 29 is similarly provided on the take-up-reel side for the same purpose. The respective reel covers are provided with end edges 30, 31. At the root part of the end edges, the protruding members 27 and 27 protrude rightward and leftward in the horizontal direction with substantially the same lateral dimension as that of the end edges 30 and 31 of the above stated reel covers 28 and 29. Therefore, due to the presence of the protruding members 27 and 27, the above-mentioned end edges 30 and 31 of the respective reel covers 28 and 29 of the feed reel 4 and the take-up reel 5 can be avoided from coming into contact with the inner wall of the main body 2. Consequently, while the transfer head support member 18 is prevented from oscillating in the vertical or a horizontal direction, the cartridge body 15 is guided toward the opening part 6 of the main body 2. Accordingly, the support member 18 can be smoothly guided to the opening part 6 of the main body 2. Further, the assembly of the character eraser case 1 or the changing of the cartridge body 15 for winding and circulating the correction paint transfer tape 3 can be easily and effectively carried out. In these operations, the breakage of the correction paint transfer tape 3 such as by cutting can be prevented. A guide rod 35 is a guide employed for smoothly taking up the transfer tape 3 by the take-up reel 5.

FIG.9 illustrates the main body 2 forming the character eraser case 1. The cartridge body 15 is inserted into and is releasably attached to the main body 2. The end of the transfer head support member 18 which is integrally connected with cartridge body 15 is projected from the opening part 6. Protruding edges 33 and 33 continuously extend in the vertical direction of the inner wall 32 of the main body 2. The protruding edges 33 and 33 extend toward the opening part 6. These protruding edges 33 and 33 are configured with contours of curved lines having an appropriate curvature so that the end of the transfer head 9 is not caught by the protruding edges 33 and 33 even when the transfer head 9 accidentally comes into contact with them.

Upon assembling the character eraser case 1, and change of the tape 3 or the cartridge body 15 for feeding and winding the correction paint transfer tape 3, when this cartridge body 15 is to be mounted integrally on the main body 2, the cartridge body 15 is initially inserted into the main body 2. At this time, even when the transfer head 9 is put into contact with the inner wall 32 of the main body 2, particularly, the base end of the slide cover 21, the transfer head 9 comes into contact with the above stated protruding edges 33 and 33, since the protruding edges 33 and 33 continuously protrudes and extends toward the opening part 6 in the vertical direction of the inner wall 32 of the main body 2. Then, the transfer head 9 is guided toward the opening part 6 of the main body 2 by these protruding edges 33 and 33 acting as a guide. Therefore, even if the transfer head 9 which is integrally connected with the cartridge body 15 oscillates particularly in the vertical direction, it is ensured that the transfer head 9 can be mounted in the main body 2 in a smooth manner without being caught by the inner wall 32 of the main body 2. Furthermore, the breakage of the correction paint transfer tape 3 such as by cutting can be avoided in the course of the above-mentioned operations.

Moreover, since the cartridge body 15 provided with the above-mentioned protruding members 27 is suitably combined with the main body 2 provided with the protruding edges 33, the insertion of the cartridge body 15 into the main body 2 can be more smoothly and effectively achieved.

As mentioned hereinbefore, in a character eraser member of a tape feed type using reels, which have been conventionally thrown away because of a troublesome operation for replacing a tape, both the cartridge body and the main body can be constructed with a simple structure and at low cost. In this character eraser member described above according to the present invention, the replacement of a correction paint transfer tape by a new one can be facilitated and a recycling of a case can be realized. When the character eraser member is not being used, a transfer head for exposing a correction tape is housed in a sliding member. Thus, stains in the periphery of the character eraser member or loss in the correction paint transfer tape are prevented. In addition, guides are provided in a tubular member, and therefore, not only the twisting or looseness of the correction paint transfer tape in the tubular member but also the loss of the correction tape can be avoided. The above-mentioned excellent effects can be accomplished in the character eraser member according to the present invention.

Although the description refers to the character eraser member of a type according to the invention provided with the above-described construction, it will be understood that other arrangements and modifications are contemplated to be involved in the present invention without departing from the scope or spirit of the invention.

What is claimed is:

1. A character eraser case comprising:

a main body having a first opening in a proximal end thereof and a second opening in a distal end thereof, said main body further including a main body part and a hollow slide cover disposed within said main body part extending from said distal end of said main body toward said proximal end of said main body, said slide cover being slidable relative to said main body part between a retracted, operating position and an extended, non-operating position;

a cartridge body insertable into said main body through said first opening, said cartridge body being releasably attached to said main body;

a substrate attached to said cartridge body and disposed within said main body;

a transfer head having a tip end, said transfer head being connected to said substrate;

a feed reel and a take-up reel, each of said reels being rotatably mounted on said substrate, said feed reel being effective for supplying a correction paint transfer tape to said tip end of said transfer head and said take-up reel being effective for rewinding the tape after use;

gear means for coupling said feed reel and said take-up reel;

wherein said tip end of said transfer head is disposed within said slide cover when said slide cover is disposed in said extended, non-operating position so as to protect the correction paint transfer tape, and wherein said tip end of said transfer head protrudes through said second opening of said main body beyond said slide cover when said slide cover is disposed in said retracted, operating position so as to expose the transfer tape for use.

2. The character eraser case as recited in claim 1, further comprising:

a transfer head support member having one end attached to said substrate and an opposite end supporting said transfer head; and at least one transfer tape guide attached to said transfer head support member and effective for supporting and guiding the side edges of the transfer tape.

3. The character eraser case as recited in claim 2, further comprising:

a head cover attached to said transfer head support member, said head cover forming a tape feed passage and a tape take-up passage, said passages extending from a location proximate said tip end of said transfer head into said second opening of said main body;

wherein said tip end of said transfer head extends beyond said head cover.

4. The character eraser case as recited in claim 1, further comprising:

means for preventing contact between an inner wall of said main body and said feed and take-up reels during insertion of said cartridge body, said substrate, and said transfer head into said main body, said means for preventing comprising a plurality of protruding members attached to and extending from said cartridge body.

5. The character eraser case as recited in claim 1, further comprising:

means for guiding said transfer head toward said second opening of said main body during insertion of said cartridge body, said substrate and said transfer head into said main body, said means for guiding comprising a plurality of protruding edges protruding from an inner wall of said main body;

wherein said protruding edges extend along said inner wall of said main body.

6. The character eraser case as recited in claim 1, wherein:

said substrate further includes a feed reel shaft and a take-up reel shaft, said feed and take-up reels being rotatably mounted on said feed reel shaft and said take-up reel shaft, respectively.

7. The character eraser case as recited in claim 6, wherein:

said feed reel and said take-up reel are disposed on opposite sides of said substrate.

8. The character eraser case as recited in claim 6, wherein:

said gear means comprises a feed reel gear coaxial with said feed reel shaft and a take-up reel gear coaxial with said take-up reel shaft;

said feed reel gear meshes with said take-up reel gear.

9. The character eraser case as recited in claim 1, wherein:

said cartridge body, said substrate and said transfer head are formed as a unitary member.

10. A character eraser case comprising:

a main body having a first opening in a proximal end thereof and a second opening in a distal end thereof;

a cartridge body insertable into said main body through said first opening, said cartridge body being releasably attached to said main body;

a substrate attached to said cartridge body and disposed within said main body;

a transfer head having a tip end, said transfer head being connected to said substrate;

a feed reel and a take-up reel, each of said reels being rotatably mounted on said substrate, said feed reel being effective for supplying a correction paint transfer tape to said tip end of said transfer head and said take-up reel being effective for rewinding the tape after use;

gear means for coupling said feed reel and said take-up reel;

wherein said cartridge body, said substrate and said transfer head are formed as a unitary member.

11. The character eraser case as recited in claim 10, wherein:

said feed reel and said take-up reel are disposed on opposite sides of said substrate and are disposed in superposition with respect to one another.

* * * * *